United States Patent [19]

Nielsen

[11] 4,323,177

[45] Apr. 6, 1982

[54] PISTON FOR EJECTING A VISCOUS OR PLASTIC MASS

[76] Inventor: Ole S. M. Nielsen, Bakkefaldet 36, DK.2840 Holte, Denmark

[21] Appl. No.: 190,324

[22] PCT Filed: Mar. 13, 1979

[86] PCT No.: PCT/DK79/00009

§ 371 Date: Nov. 14, 1979

§ 102(e) Date: Nov. 13, 1979

[87] PCT Pub. No.: WO79/00758

PCT Pub. Date: Oct. 4, 1979

[30] Foreign Application Priority Data

Mar. 14, 1978 [DK] Denmark ..... 1149/78

[51] Int. Cl.[3] ..... B67D 5/46

[52] U.S. Cl. ..... 222/386

[58] Field of Search ..... 222/386, 325, 326, 327; 92/216, 219

[56] References Cited

U.S. PATENT DOCUMENTS

| | | | |
|---|---|---|---|
| 2,430,718 | 11/1947 | Jacobson | 222/386 |
| 2,695,735 | 11/1954 | Doornik | 222/386 |
| 2,887,253 | 5/1959 | Biedenstein | 222/327 |
| 2,941,699 | 6/1960 | Schmidt et al. | 222/327 |
| 3,178,074 | 4/1965 | Sundholm | 222/386 |

FOREIGN PATENT DOCUMENTS

| | | | |
|---|---|---|---|
| 2034047 | 8/1971 | Fed. Rep. of Germany . | |
| 2326249 | 11/1974 | Fed. Rep. of Germany . | |
| 411933 | 7/1945 | Italy | 222/386 |

*Primary Examiner*—Stanley H. Tollberg

*Attorney, Agent, or Firm*—Dennison, Meserole, Pollack & Scheiner

[57] ABSTRACT

An ejection piston for use in cylindrical dispensing containers or packages of the type containing viscous or plastic masses such as sealing compounds and adhesives. The piston assembly comprises a piston part having a peripheral skirt as well as an arched piston top, and a separate piston actuating member arched in a direction opposite to the piston top. An ejection pressure is applied to the actuating member and transmitted to the piston top whereby the effective diameter of the piston top is slightly increased. An annular sealing sleeve for receiving the piston skirt and the adjacent free end of the cylindrical container during storage may be formed integrally with the piston actuating member.

6 Claims, 4 Drawing Figures

PISTON FOR EJECTING A VISCOUS OR PLASTIC MASS

Figure 1:
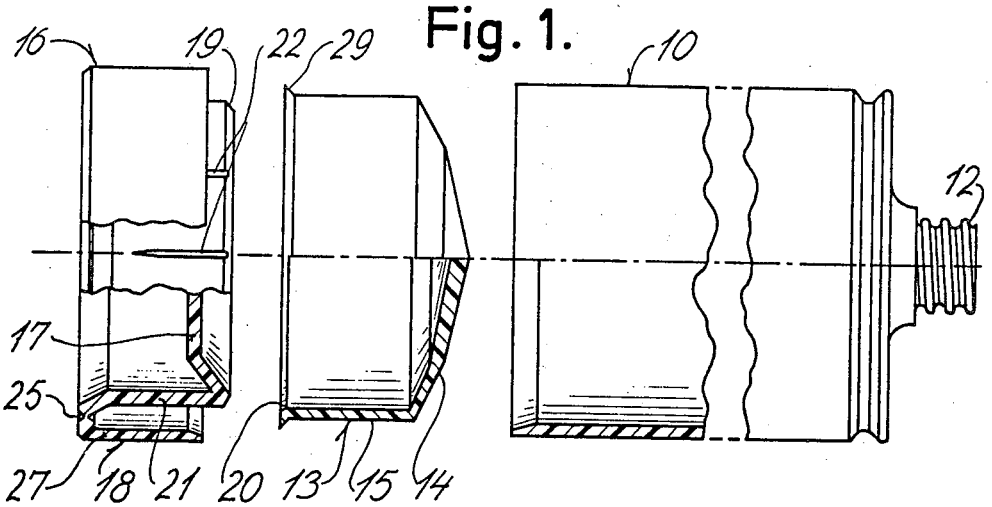

The present invention relates to a piston for ejecting a viscous or plastic mass from a cylindrical container or package, said piston comprising a peripheral skirt closed at one end by an end wall or piston top arched in a direction away from said skirt.

Cylindrical containers or packages or so-called "cartridges" made from metal, plastic, cardboard or pasteboard are often used for containing sealing compounds, adhesives, or other liquid or plastic masses. Cylindrical containers or packages of the above type are normally provided with a discharge spout at one one end while the other end is closed by means of a piston. When the content of such package is to be used the package is normally arranged in a so-called "pistol" or another device by means of which a pressure may be applied to the piston of the package either manually or by means of pressurized air, whereby the content of the package is injected or discharged through said spout.

When a manufacturer of viscous or plastic masses fills these masses into containers or packages of the above type and closes the open end of each of the filled containers or packages by means of an ejection piston it is of substantial importance to avoid confinement of greater air bubbles in the container. Firstly, some types of masses usually packed in the said containers, such as sealing compounds and adhesives, may become deteriorated in quality when they come into contact with atmospheric air, and secondly, such air inclusions may give rise to an undesired splashing or splattering effect when the content of such package is later ejected through the discharge spout. Therefore, when the ejection piston is mounted in the filled container or package it should not engage sealingly with the inner cylindrical wall of the container because air should be allowed to escape from the inner space of the container defined by the piston. However, when at a later time a user wants to eject or discharge the content from the container by applying a pressure to the piston, the piston should engage so tightly with the inner cylindrical container wall that no substantial part of the container mass may leak out between the piston and the cylindrical container wall, not even when said wall is made from a resilient material.

An attempt has been made to fulfil these apparently self-contradictory requests or conditions by the provision of the piston structure disclosed in German Pat. specification No. 2 034 047. This known piston is formed as an integral unit having an annular first abutment portion extending from the central part of the piston top, and a second inclined abutment surface extending from the periphery of the piston top and being directed towards the axis of the piston. When this known ejection piston is inserted into a filled cylindrical container or package at a factory, a pressure is primarily applied to the said first central abutment portion. Such inward pressure applied to said first abutment portion will tend to increase the curvature of the piston top and, consequently, to reduce the diameter thereof, whereby possible air confined within the container or package may escape when the piston is mounted. When the content of the container or package is later to be ejected an ejection pressure is applied to the piston through a piston rod or a similar member which preferably engage with the said second inclined abutment portion extending from the periphery of the piston top. The axially directed pressure applied to the said abutment portion tends to reduce the curvature or arching of the piston top and, consequently, to increase the diameter of the piston, whereby a satisfactory tight engagement may be obtained between the piston and the inner cylindrical wall of the container.

However, the said known piston has several serious disadvantages. Thus, the piston which is normally made from plastic by injection moulding, is difficult to produce due to the inclined second abutment portion. Furthermore, the said second abutment portion tends to increase the rigidity of the piston top and thus to counteract the desired reduction of the diameter of the piston top during mounting of the piston in the container as described above. As understood from the above explanation it is important to have the ejection pressure transmitted to the piston through said inclined second abutment portion, and therefore it is necessary to use a piston rod or a similar pressure actuating member having an abutment surface especially adapted to engage with said inclined second abutment portion. Consequently, the said known piston requires use of special pistols or ejection apparatuses, and by use of an ejection apparatus of the type in which the ejection piston of the container is directly exposed to pressurized air the said inclined second portion will not function to increase the diameter of the piston top as described above.

U. S. Pat. specification No. 3,193,146 discloses an ejection piston having a piston top which is arched outwardly, i.e. in the direction of the piston skirt. When the piston top of that known piston is exposed to an axially directed ejecting force, such force will tend to reduce the arching of the piston top and consequently increase the diameter thereof, whereby a tight engagement between the piston and the cylindrical inner wall of the corresponding container may be obtained. However, when a piston of that known type is used it cannot be avoided that a relatively great volume of air be confined or included within the container or package which is very disadvantageous as explained above and in many cases completely unacceptable.

The present invention provides a piston of the above type, and the piston according to the invention is characterized in further comprising a separate piston actuating member arranged within the piston skirt so as to engage with the piston top at the periphery thereof, said actuating member being arched in a direction opposite to the arching of the piston top.

Thus, the piston according to the invention may comprise a simple piston part including a piston skirt and an arched piston top closing one end thereof. Such piston part may be introduced into the open end of a filled, cylindrical ejection container or package, and air may easily escape from the container, especially when the piston top is pressed into the container by applying a pressure to the central part of the piston top. When this piston part has been mounted the separate piston actuating member may be inserted therein. The piston top and the piston actuating member engaging therewith are arched in opposite directions, and when the piston actuating member is exposed to an axially inwardly directed ejecting pressure the piston top is simultaneously exposed to an oppositely directed counterpressure from the viscous mass contained in the container. These oppositely directed axial pressures acting on the piston top and the actuating member tend to increase the diameter of the piston top, whereby a tight engagement between the periphery of the piston top and the adjacent cylindrical inner wall of the container may be obtained.

Preferably, said piston actuating member forms a transversely and continuously extending wall similar to the piston top, but being arched in an opposite direction. Provided that the peripheral part of the actuating member is in sealing engagement with the piston top or with the inner wall of the piston skirt the necessary ejection force may be applied to the actuating member by exposing it directly to pressurized air. The necessary ejection pressure may, alternatively, be transmitted to the actuating member by means of a piston rod or a similar member. In the latter case a central opening and/or other kinds of openings or cut-outs may be provided in the actuating member.

The piston top and/or the actuating member may advantageously be provided with guide means for mutually guiding said piston top and said actuating member during relative axial movement thereof. These guide means may, for example, include axially extending and telescopically engaging tube members.

It is known to obtain an improved sealing of cylindrical containers or packages of the type described by providing these containers with an annular sealing sleeve having a substantially U-shaped cross-section and tightly receiving the free end of the piston skirt and the adjacent free end of the cylindrical container wall. The improved sealing of the container which may be obtained by means of such sealing sleeve may in several cases increase the storability of the product in the container. According to the invention such sealing sleeve may be formed integrally with the actuating member and a weakening zone or line may be formed in the sleeve at the bottom of the U-shaped cross-section. The piston actuating member may advantageously be made from plastic by injection moulding, and the provision of an integral sealing sleeve will not substantially increase the manufacturing costs. When the content of the container or package is to be used and a sufficient axially inwardly directed ejection pressure is applied to the piston actuating member the sealing sleeve will rupture along the weakening zone or line whereby the outer wall of the sealing sleeve is separated from the actuating member. The remaining inner wall of the sealing sleeve engaging with the inner wall of the piston skirt may function as a guide member for the piston actuating member.

When the piston actuating member is provided with the said annular sealing sleeve the inner wall of the sealing sleeve may engage so tightly with the inner surface of the piston skirt that air enclosed between the piston actuating member and the piston top may resist insertion of the piston actuating member in the piston skirt. In order to allow air to escape from the space defined in the piston between the piston top and the piston actuating member one or more axially extending venting grooves may be formed in the surface part of the sealing sleeve adapted to engage with the inner surface of the piston skirt. The piston part forming the piston top and the piston skirt may be made from one material while the piston actuating member which may comprise a sealing sleeve may be made from another different material for example different plastic materials having different properties. As an example, the said piston part may be injection moulded from a plastic material which is especially impervious to water vapour and/or solvent included in the mass contained in the package or container, for example polyethlyene, polypropylene, or polyamide. The piston actuating member may, for example, be made from polyacetal or another plastic material which is especially stable as to shape. The two separate piston parts may, alternatively, be made from two different materials having different physical properties. Thus, the piston part including the piston top and the piston skirt may be made from a relatively deformable plastic material while the piston actuating member may be made from a less deformable material.

In the present specification the term "arched" should be interpreted in its broad sense and is intended to comprise any dished or concave shape. Thus, the piston actuating member may advantageously comprise a substantially plane central portion for engaging with an abutment surface formed on a piston rod of an ejection pistol.

Figure 2:
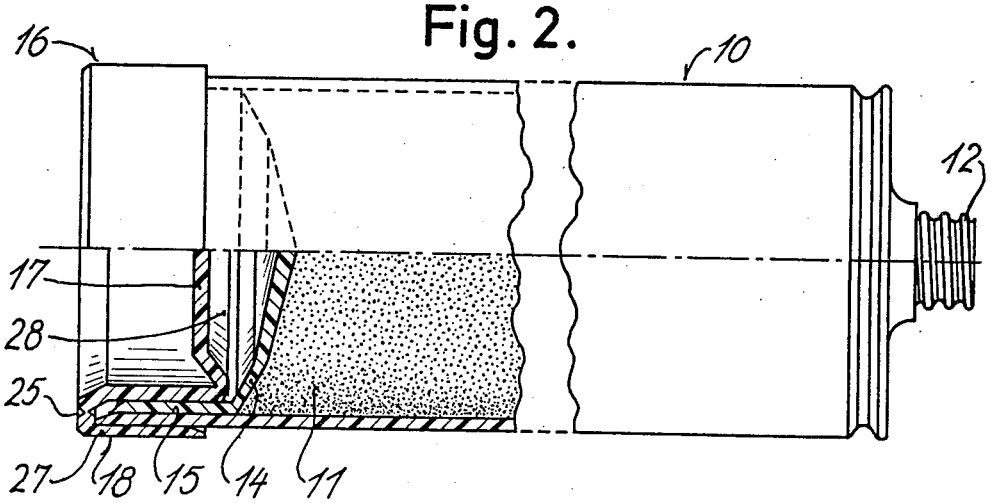
Figure 3:
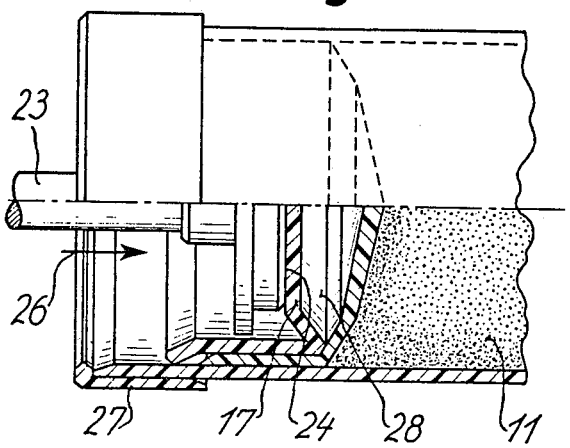
Figure 4:
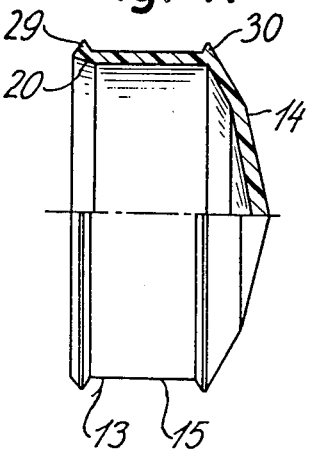

The invention will now be further described with reference to the drawings, wherein FIG. 1 is an exploded view partially in section of an empty cylindrical container with an ejection piston according to the invention, FIG. 2 is a side view and partial sectional view of the container or package shown in FIG. 1 in a filled condition and with the piston mounted, FIG. 3 is a side view and partial sectional view of the left end portion of the container or package shown in FIG. 2 in the condition where part of the container content has been ejected by means of the piston, and FIG. 4 is a side view and partial sectional view of a slightly modified embodiment of a piston part.

The drawings show a cylindrical package or ejection container 10 for storing and later ejection or discharge of a viscous or paste-like mass 11. The package 10 is closed at one end and at that end it is provided with a discharge spout or a threaded pipe stub 12 (as shown in the drawings) for mounting such spout when the content of the container or package is to be ejected or discharged. The opposite open end of the container 10 may be closed by means of a plunger or piston structure consisting of two separate parts, namely a piston part 13 forming an arched or dished piston end wall or piston top 14 as well as a cylindrical piston skirt 15, and a sealing member 16 comprising a piston actuating member 17 arched or dished in a direction opposite to the arching of the piston top 14 and a sealing sleeve 18 formed integrally with the actuating member and having a substantially U-shaped cross-section as best shown in FIG. 1.

The container or package 10 may be made from any suitable material such as metal or pasteboard, or it may be injection moulded from plastic as in the embodiment shown in the drawings. As mentioned above, the container or package is intended for storing and later ejecting or discharging a viscous or paste-like material, such as a sealing compound or an adhesive. When the product or mass 11 has been filled into the container the piston part 13 is inserted into the open end of the container, preferably by applying an axial pressure to the central part of the piston top 14 which may have a wall thickness exceeding that of the peripheral portion of the piston top as shown in the drawings. When the piston top 14 is exposed to such inwardly directed axial pressure and to a corresponding counter pressure from the mass 11 the curvature of the piston top 14 will tend to increase whereby the diameter of the piston top will decrease to such an extent that the piston part 13 does not engage in an air tight manner with the inner cylindrical surface of the container 10. Consequently, air may escape from the container 10 when the piston part 13 is inserted therein whereby the arched piston top 14 may be brought into contact with the mass 11 without inclusion of any substantial volume of air between the piston top and the mass. When the piston part 13 has been mounted the arched piston actuating member 17 of the sealing member 16 may be inserted into the container 10 and the piston skirt 15. The outer diameter of the piston actuating member 17 may slightly exceed the inner diameter of the piston skirt 15 so that the piston skirt will be pressed radially outwardly and into sealing engagement with the container wall when the actuating member 17 is inserted, and the introduction of the piston actuating member 17 into the piston skirt 15 may be facilitated by an outer chamfering 19 at the piston actuating member and an inner chamfering 20 at the piston skirt 15. These chamferings will also tend to centre the piston part 13 within the container 10 when the sealing member 16 is mounted. Axially extending channels or grooves 22 may be formed in the outer surface of the inner wall 21 of the sealing sleeve as shown in FIG. 1 for allowing enclosed air to escape when the piston actuating member is inserted. The actuating member 17 may be pushed into the piston skirt 15 till the free edge of the container 10 comes into contact with the bottom of the U-shaped sealing sleeve 18. Normally, the peripheral part of the piston actuating member 17 will then be positioned axially spaced from the peripheral portion of the piston top 14, as shown in FIG. 2. In this position the sealing member 16 and the piston part 13 sealingly close the end of the container 10, because the piston actuating member 17 prevents tilting of the piston 13 while the inner wall of the sealing sleeve 18 is pressing a sealing lip or bead 29 formed at the free end of the piston skirt into tight engagement with the cylindrical inner wall of the container 10. The container 10 with its content is now ready for storage or shipment.

When the container or package 10 reaches the user who wants to discharge the mass 11 from the container a suitable discharge spout (not shown) is screwed on the treaded tube stub 12 the passage or opening of which may, for example, be closed by an easily perforable membrane or wall. Thereafter, the container or package shown in FIG. 2 is arranged in an ejection pistol or another ejection device which may include a piston rod 23 having a plane abutment surface 24 (FIG. 3) at its free end for engagement with a plane central portion of the piston actuating member 17. The sealing sleeve 18 has an annular weakening line 25 formed at its outer end, i.e. at the bottom of the annular channel formed by the sealing sleeve, FIGS. 1 and 2. When a suitable force is applied to the piston rod 23 so as to press the same into the container 10 in the direction indicated by the arrow 26 the sealing sleeve will rupture along the weakening line 25, whereby the outer ring-shaped wall 27 of the sealing sleeve will remain at its position around the outer end of the container while the other part of the sealing member will be pushed inwardly into the container so that the peripheral portion of the piston actuating member 17 comes into contact with the peripheral portion of the piston top 14.

The piston top 14 and the piston actuating member 17 now engaging each other along their peripheral portions and being arched in opposite directions define a chamber 28 therebetween. When a force is applied to the actuating member 17 by the piston rod 23 in the direction indicated by the arrow 26 the piston top will be exposed to an oppositely directed counterpressure provided by the mass 11 whereby the chamber 28 will be compressed. Such compression causes an increase in diameter of the chamber and consequently of the piston top 14, whereby the peripheral part of the piston top is pressed into tight engagement with the inner cylindrical wall of the container or package 10. It is understood that the sealing pressure between the piston top and the cylindrical wall will increase when the ejection pressure increases. In addition to the sealing lip 29 shown in FIG. 1 the piston part 13 may also be provided with a sealing lip or bead 30 at the periphery of the piston top 14 as shown in the modified embodiment of FIG. 4. When the container 10 is used in connection with an ejection device of the type in which the piston structure is directly exposed to pressurized air the sealing lips 29 and 30 will be pressed radially outwardly against the inner wall of the container 10 and thereby prevent pressurized air from penetrating into the mass 11.

It should be understood that various changes and modifications of the embodiment shown on the drawings may be made within the scope of the present invention. Thus, in principle the sealing member 16 may consist only of the actuating member 17 combined with some type of guiding means such as the annular wall 21 or a central tubular projection formed on the actuating member 17 and engaging telescopically with a corresponding oppositely directed tubular extension formed on the piston top 14. Each of the two parts 13 and 16 forming the piston structure may have such a shape that they may easily be made by injection moulding. Furthermore, as mentioned above the fact that the piston structure is made from two separate parts makes it possible to make these parts from different materials having different desired mechanical or physical properties. The piston actuating member 17 and the piston top may have any suitable arched or dished shape with an edged or curved cross-sectional shape. As a border line case the actuating member 17 or the piston 14 may also have a substantially plane shape.

I claim:

1. A piston assembly for ejecting a viscous or plastic mass from a cylindrical dispensing container, said assembly comprising a piston member having an open end, a peripheral skirt and being closed on the other end by a piston top arched in a direction away from said open end, a separate piston actuating member received within said piston member skirt and engaging with the periphery of said piston top, said actuating member including a transverse wall portion which is arched in a direction opposite to that of said piston top, said piston top being deformable whereby when inserted into said container under the influence of an inwardly directed axial force applied to the central part thereof its effective diameter is reduced to allow trapped air to pass between said skirt and the container wall, and whereby the effective diameter will increase to seal the skirt against the container wall when axial force is applied to the periphery of said piston top by said actuating member.

2. A piston assembly as defined in claim 1 wherein said actuating member includes guide means for mutually guiding said actuating member in relation to said piston top during relative axial movement thereof.

3. A piston assembly as defined in claim 2 and further including an annular sealing sleeve integral with said actuating member, said sleeve having a substantially U-shaped cross-section and being adapted to tightly receive said piston skirt and an adjacent end of the container wall, and a weakened zone in said sleeve at the bottom of said U-shaped cross-section.

4. A piston assembly as defined in claim 3 and further including at least one axially extending venting groove formed in the surface of said sealing sleeve engaging the inner surface of said piston skirt.

5. A piston assembly as defined in any one of claims 1 through 4, wherein said separate actuating member is formed of a material different from that of which the piston member is made.

6. A piston assembly as defined in any one of claims 1 through 4 wherein said piston actuating member includes a substantially planar central surface face.

* * * * *